US010559414B2

(12) United States Patent
Kwon et al.

(10) Patent No.: US 10,559,414 B2
(45) Date of Patent: Feb. 11, 2020

(54) WIRE-WOUND TYPE POWER INDUCTOR

(71) Applicant: SAMSUNG ELECTRO-MECHANICS CO., LTD., Suwon-si, Gyeonggi-do (KR)

(72) Inventors: Soon Kwang Kwon, Suwon-si (KR); Young Seuck Yoo, Suwon-si (KR); Jung Wook Seo, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 35 days.

(21) Appl. No.: 15/678,792

(22) Filed: Aug. 16, 2017

(65) Prior Publication Data

US 2018/0151285 A1 May 31, 2018

(30) Foreign Application Priority Data

Nov. 28, 2016 (KR) ..... 10-2016-0159501

(51) Int. Cl.

| | |
|---|---|
| ***H01F 27/24*** | (2006.01) |
| ***H01F 37/00*** | (2006.01) |
| ***H01F 3/08*** | (2006.01) |
| ***H01F 27/255*** | (2006.01) |
| ***H01F 3/10*** | (2006.01) |
| ***H01F 27/28*** | (2006.01) |
| *H01F 27/26* | (2006.01) |

(52) U.S. Cl.

CPC ..... *H01F 27/24* (2013.01); *H01F 3/08* (2013.01); *H01F 3/10* (2013.01); *H01F 27/255* (2013.01); *H01F 27/2823* (2013.01); *H01F 37/00* (2013.01); *H01F 27/263* (2013.01)

(58) Field of Classification Search

CPC ..... H01F 3/08; H01F 3/10; H01F 3/04; H01F 27/24; H01F 27/2823; H01F 27/255; H01F 27/263; H01F 27/25; H01F 27/2828; H01F 27/287; H01F 27/29; H01F 27/292; H01F 37/00

USPC ..... 336/233, 221, 192, 212, 214, 215, 218

See application file for complete search history.

(56) References Cited

U.S. PATENT DOCUMENTS

| | | | | |
|---|---|---|---|---|
| 5,760,669 | A * | 6/1998 | Dangler | H01F 17/043 336/192 |
| 9,997,288 | B2 * | 6/2018 | Yamaguchi | H01F 17/0006 |
| 10,147,540 | B2 * | 12/2018 | Tonoyama | H01F 41/04 |
| 2009/0002117 | A1 * | 1/2009 | Kawarai | H01F 17/0006 336/233 |

(Continued)

FOREIGN PATENT DOCUMENTS

| | | | |
|---|---|---|---|
| JP | 2009-009985 | A | 1/2009 |
| KR | 10-2014-0077346 | A | 6/2014 |

*Primary Examiner* — Mang Tin Bik Lian

(74) *Attorney, Agent, or Firm* — Morgan, Lewis & Bockius LLP

(57) ABSTRACT

A wire-wound type inductor includes a core containing magnetic powder flakes and including a central portion and an outside portion, and a winding coil disposed in the core and wound around the central portion of the core, wherein the core has a coupling structure including first and second bodies, and the first and second bodies contain magnetic powder flakes having shape magnetic anisotropy, and long axes of the magnetic powder flakes are arranged in parallel with a direction in which a magnetic field of the winding coil is formed.

19 Claims, 17 Drawing Sheets

I - I'

(56) References Cited

U.S. PATENT DOCUMENTS

| | | | | |
|---|---|---|---|---|
| 2009/0243780 | A1* | 10/2009 | Inoue | H01F 1/15366 336/200 |
| 2009/0295526 | A1* | 12/2009 | Mikami | C01G 49/009 336/196 |
| 2010/0176907 | A1* | 7/2010 | Hayasaki | H01F 27/263 336/220 |
| 2010/0308949 | A1* | 12/2010 | Lim | H01F 17/0013 336/218 |
| 2014/0167897 | A1* | 6/2014 | Choi | H01F 27/255 336/83 |
| 2014/0320250 | A1* | 10/2014 | Yamada | H01F 27/2823 336/192 |
| 2016/0099098 | A1* | 4/2016 | Yamaguchi | H01F 17/0006 336/221 |

* cited by examiner

II - II'

V – V'

WIRE-WOUND TYPE POWER INDUCTOR

CROSS-REFERENCE TO RELATED APPLICATION(S)

This application claims the benefit of priority to Korean Patent Application No. 10-2016-0159501, filed on Nov. 28, 2016 with the Korean Intellectual Property Office, the disclosure of which is incorporated herein by reference in its entirety.

TECHNICAL FIELD

The present disclosure relates to a wire-wound type power inductor, and more particularly, to a wire-wound type power inductor including a core having a bonding structure.

BACKGROUND

In general, since ferrite or metal powder used as a magnetic material in an inductor having a shape close to a spherical shape, when a magnetic field is applied, the magnetic field is equally distributed in all directions rather than in a specific direction. Here, in a case of using a plate-shape magnetic powder flake of which a long axis and a short axis have different lengths from each other, since a distance between both end portions of the plate-shaped magnetic powder flake with respect to a short axis is shorter than a distance between both end portions thereof with respect to a long axis, the plate-shaped magnetic powder flake is easily magnetized along its long axis rather than its short axis. In a case of using a magnetic sheet containing the plate-shaped magnetic powder flake having shape magnetic anisotropy as described above, an inductor having high permeability may be manufactured.

A method of disposing a plate shaped sheet formed of metal powder in upper and lower cover parts, in order to secure high permeability by stacking a magnetic sheet containing the plate-shaped powder flake as described above, has been disclosed in Korean Patent Laid-Open Publication No. 10-2014-0077346. However, in a case of stacking a plurality of sheets, a formation process may be complicated, and it may be difficult to secure uniformity in stacking the sheets.

SUMMARY

An aspect of the present disclosure may provide a power inductor having high permeability, while solving the above-mentioned problem.

According to an aspect of the present disclosure, a wire-wound type inductor may include a core containing magnetic powder flakes and a winding coil in the core. The core may be functionally divided into a central portion and an outside portion, excluding the central portion, and the winding coil may be wound around the central portion of the core. Meanwhile, the core may have a bonding structure of first and second bodies, the magnetic powder flakes contained in the first and second bodies may be magnetic powder flakes having shape magnetic anisotropy, and long axes of the magnetic powder flakes may be arranged in parallel in a direction in which a magnetic field of the winding coil is formed.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, exemplary embodiments of the present disclosure will be described in detail with reference to the accompanying drawings.

Hereinafter, a wire-wound type power inductor according to exemplary embodiments of the present disclosure will be described, but the disclosure is not necessarily limited thereto.

Figure 1:
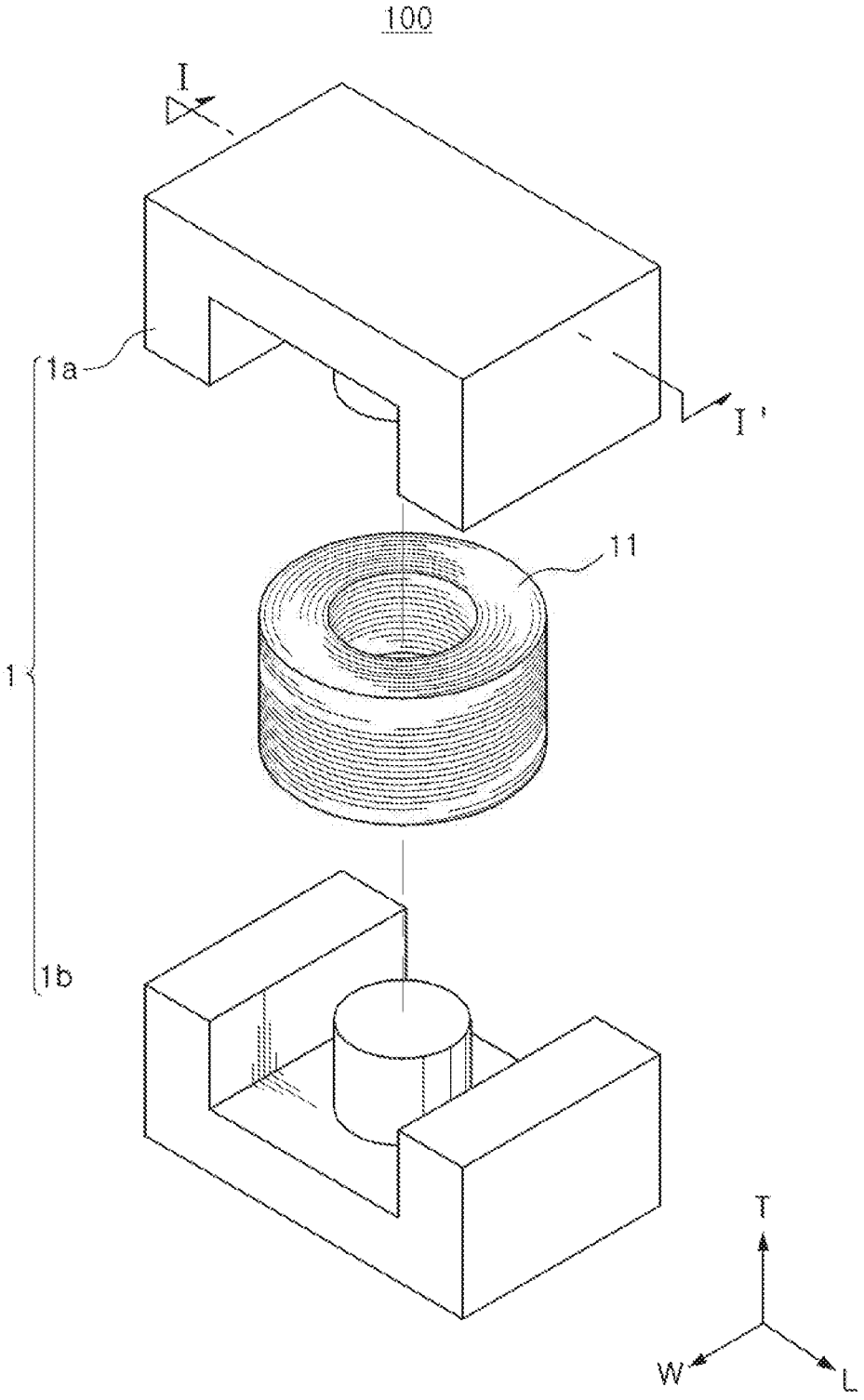
FIG. 1 is an exploded perspective view of a wire-wound type power inductor according to exemplary embodiments of the present disclosure.

FIG. 1 is an exploded perspective view of a wire-wound type power inductor 100 according to exemplary embodiments of the present disclosure. Referring to FIG. 1, the wire-wound type power inductor 100 may include a core 1 and first and second external electrodes (not illustrated) disposed on an outer surface of the core.

The core 1 may have upper and lower surfaces opposing each other in a thickness (T) direction, first and second end surfaces opposing each other in a length (L) direction, first and second side surfaces opposing each other in a width (W) direction, and a shape of the outer surface is not limited thereto.

The core 1 may be formed of a metal powder-resin composite composed of a magnetic powder having magnetic properties, and a resin disposed around the magnetic powder.

A winding coil 11 is embedded in the core 1, a first lead portion (not illustrated) of the winding coil may be connected to the first external electrode (not illustrated), and a second lead portion (not illustrated) of the winding coil may be connected to the second external electrode (not illustrated).

Hereinafter, the core 1 will be described in detail.

The core 1 may be functionally divided into a central portion of the core and an outside portion of the core which excludes the central portion of the core. The winding coil may be wound on an outer surface of the central portion of the core, such that the central portion of the core may serve as a magnetic core. Further, a method of winding the winding coil on the outer surface of the central portion of the core is not limited thereto. For example, a method of winding the winding coil using a bobbin, or a method of inserting a coil pre-wound in a specific shape and then taping around the coil may also be used. In this case, at the time of inserting the coil, the specific shape of the coil may correspond to a shape of the central portion of the core on which the coil is disposed. Referring to FIG. 1, the central portion of the core may be formed by bonding a central portion of a first body 1*a* and a central portion of a second body 1*b* to each other.

Meanwhile, the core 1 may structurally include the first body 1*a* and the second body 1*b*, excluding the first body, and may be configured by a bonding structure of the first and second bodies.

The first and second bodies may be manufactured, for example, using a die filled with a magnetic powder, and specific shapes thereof are not limited, but may be suitably designed and modified by those skilled in the art. In the method using the die, in a case of filling, for example, an insulated magnetic powder or a composite of a magnetic powder and an insulating material in the die, applying a predetermined pressure thereto, and then curing the magnetic powder or the composite at a predetermined temperature, a long axis of the magnetic powder may be arranged in a predetermined direction. Here, the magnetic powder may have shape magnetic anisotropy before the magnetic power is filled in the die, and it may be estimated that the application of the pressure to the die and the curing of the magnetic powder serve to arrange the long axis of the magnetic powder uniformly.

Meanwhile, the insulated magnetic powder may be a magnetic powder having a structure composed of a metal core 15*a* and a resin shell 15*b* enclosing an outer surface of the core. Here, the metal core 15*a* is not particularly limited, as long as the metal core is formed of a metal or alloy exhibiting magnetic properties. For example, the metal core may be formed of a Fe—Si based alloy, but is not limited thereto. Meanwhile, the resin forming the shell 15*b* may be an epoxy resin. In this case, the epoxy resin may also serve as a curing agent, such that there is an advantage in that a separate curing agent for forming the core may be omitted. The metal core and the resin shell may be directly bonded to each other without a separate inorganic insulating layer.

As illustrated in FIG. 1, the first body has an E-type structure, and the second body may also have the E-type structure similar to the first body. At the time of bonding the first and second bodies to each other to form the core, a method of bonding the first and second bodies is not limited. For example, the first and second bodies may be bonded to each other using an adhesive material 14, and, as the adhesive material, an epoxy based adhesive may be used. Alternatively, the first and second bodies may also be bonded to each other by taping so that bonding surfaces of the first and second bodies may be fixed.

Figure 2:
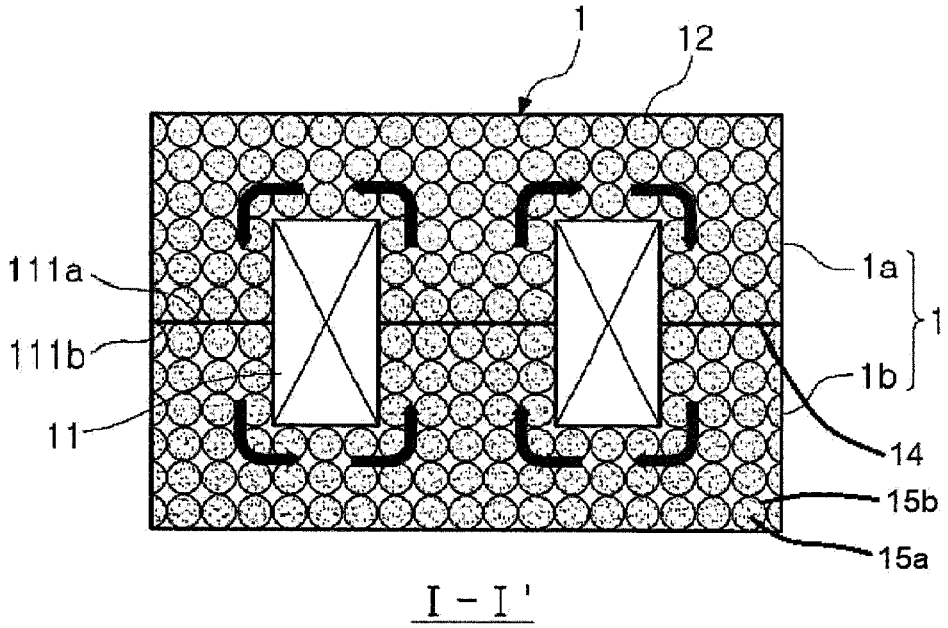
FIG. 2 is a cross-sectional view taken along line I-I' of FIG. 1.

FIG. 2 is a cross-sectional view taken along line I-I' of FIG. 1. A shape and arrangement of magnetic powder flakes contained in the core will be described in detail with reference to FIG. 2.

Referring to FIG. 2, magnetic powder flakes 12 contained in the core 1 may have shape magnetic anisotropy, and the long axes of the magnetic powder flakes 12 are arranged in parallel with a direction in which a magnetic field of the coil is formed (that is, a direction of a magnetic flux).

In a case in which the long axis of the magnetic powder flake 12 and the direction of the magnetic flux are in parallel with each other, the magnetic flux may be concentrated, such that inductance of the inductor may be increased.

Since the core 1 has a structure in which the first and second cores 1*a* and 1*b* of the core are coupled to each other after being separately formed, the magnetic powder flakes contained in the first core and the magnetic powder flakes contained in the second core may be distinguished from each other. This distinguishing may be performed through fine structure analysis, but generally may not be done by the naked eye.

In particular, the magnetic powder flakes contained in the first and second cores may be clearly distinguished from each other on a coupling surface 111*a* of the first core coupled to the second core, and on a coupling surface 111*b* of the second core coupled to the first core. For example, an adhesive, or the like, may be disposed on the coupling surfaces 111*a* and 111*b*.

Figure 3:
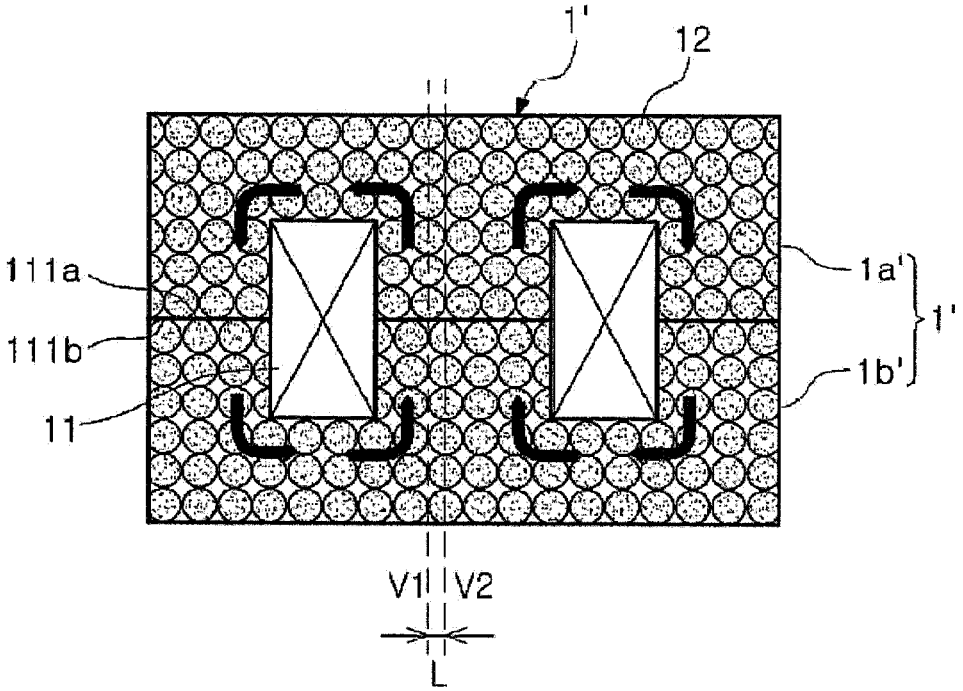
FIG. 3 is a cross-sectional view illustrating a modified example of the wire-wound type power inductor of FIG. 2.

As another example of the possibility of distinguishing the magnetic powder flakes contained in the first and second cores, regularity capable of being applied to the magnetic powder in the first core and regularity capable of being applied to the magnetic powder in the second core may be different from each other. For example, FIG. 3 is a cross-sectional view briefly illustrating a modified example of the wire-wound type power inductor of FIG. 2. Referring to FIG. 3, it may be appreciated that a straight line V1 connecting centers of magnetic powder flakes repeated in the thickness direction in a first core 1*a*' to each other, and a straight line V2 connecting centers of magnetic powder flakes, repeated in the thickness direction in a second core 1*b*', to each other, are spaced apart from each other by a predetermined interval L, to thereby be in parallel with each other.

In addition, arrangements of a straight line connecting centers of magnetic powder flakes, repeated in the thickness direction in the first core, to each other, and a straight line connecting centers of magnetic powder flakes, repeated in the thickness direction in the second core, to each other, are not limited to an arrangement illustrated in FIG. 2 or 3, but a straight line connecting centers of the two groups of magnetic powder flakes may also form a predetermined angle therebetween (not illustrated).

As described above, on any technical basis capable of supporting the fact that the first and second cores are independently formed and then coupled (assembled) to each other, the magnetic powder flakes contained in the first and second cores may be distinguished from each other, which may be applied without limitation, depending on the recognition of those skilled in the art, analytic conditions, or the like.

Figure 4A:
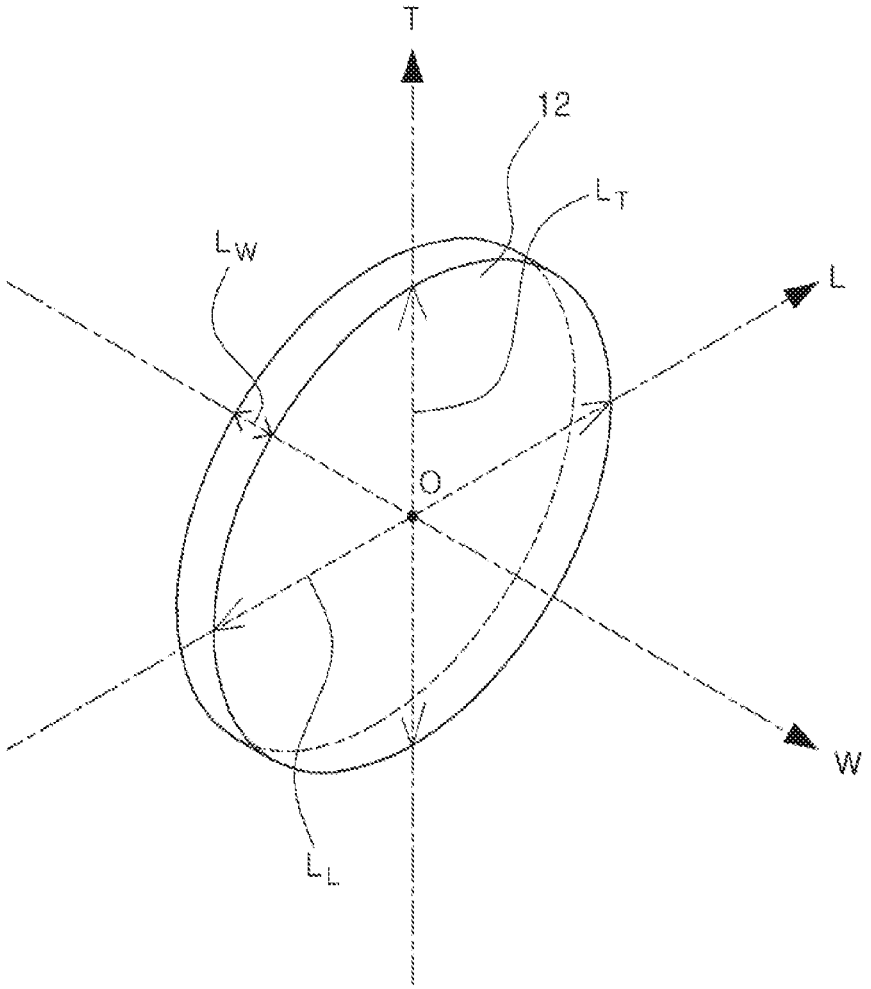
FIGS. 4A through 5B illustrate shape magnetic anisotropy of a magnetic powder.
Figure 4B:
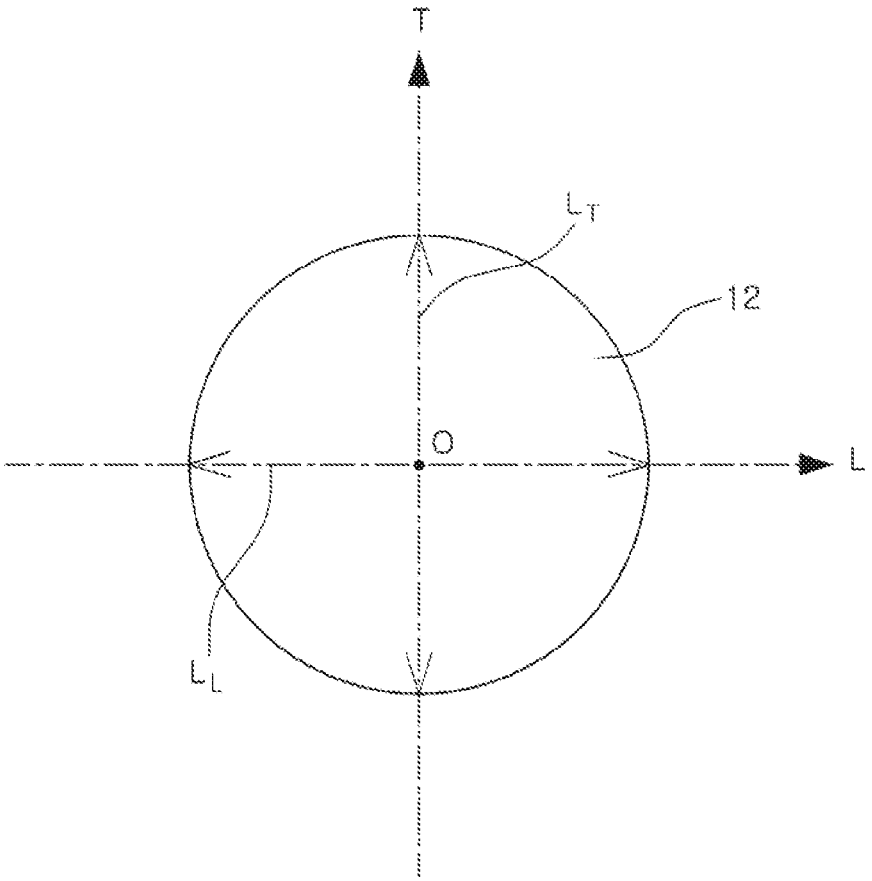

FIGS. 4A and 4B are enlarged views illustrating an arbitrary magnetic powder flake among the magnetic powder flakes 12 of FIG. 2. The long axis of the magnetic powder flake 12 having shape magnetic anisotropy will be described in detail with reference to FIGS. 4A and 4B.

Referring to FIGS. 4A and 4B, the magnetic powder flake 12 may have a plate shape and a cross section thereof may be round. In a case in which the cross section of the magnetic powder flake is round, when the center O of a flake corresponds to an intersection point of a T axis, an L axis, and a W axis, which are central axes of a three-dimensional structure, a maximum length $L_W$ of the magnetic powder flake extended in a W axis direction is shortest, a maximum length $L_L$ of the magnetic powder flake extended in an L axis direction and a maximum length $L_T$ of the magnetic powder flake extended in a T axis direction may be substantially equal to each other, and each of $L_T$ and $L_L$ may be larger than the maximum length of the magnetic powder flake extended in the W axis direction.

Therefore, the magnetic powder flakes having the plate shape illustrated in FIGS. 4A and 4B may have a plurality of long axes, and some of them may be formed to be in parallel with each of the T axis and the L axis.

Figure 5A:
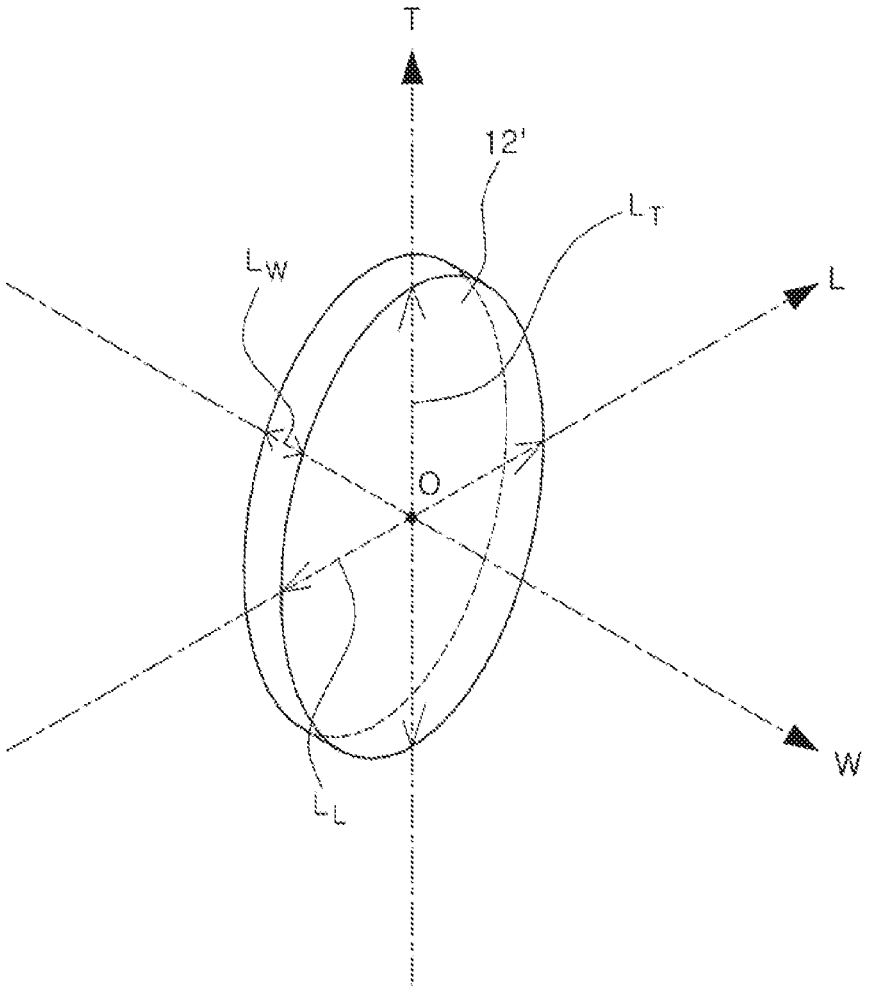
Figure 5B:
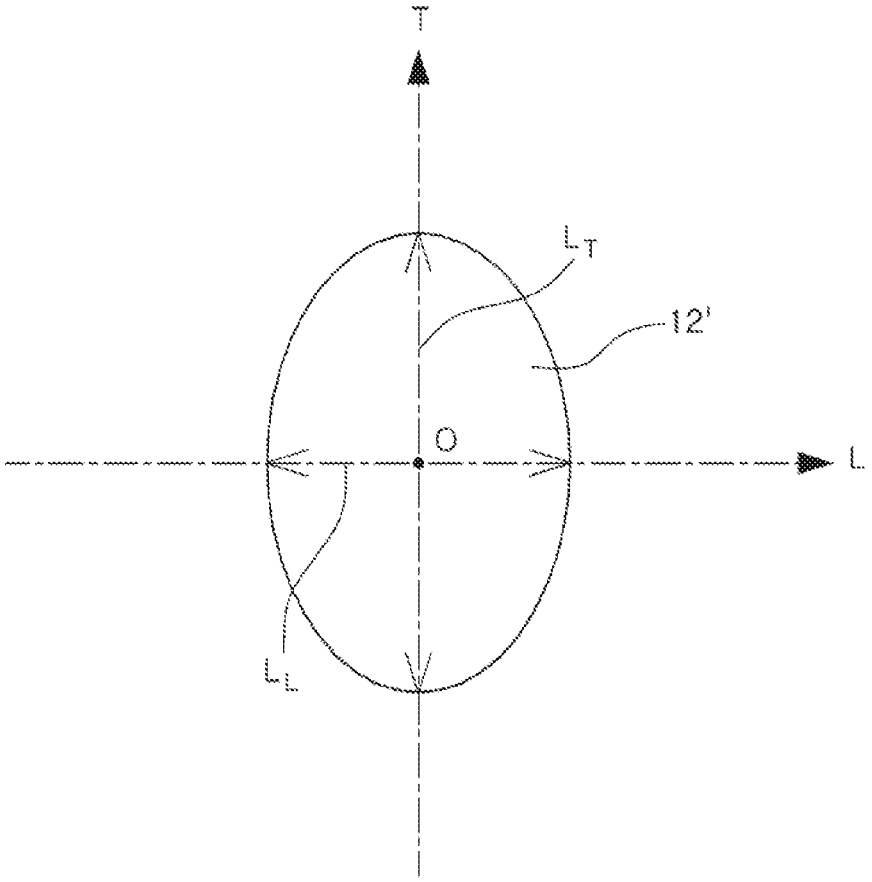

Next, FIGS. 5A and 5B illustrate a magnetic powder flake 12' corresponding to a modified example of the magnetic powder flake 12 illustrated in FIGS. 4A and 4B. A mixture of the magnetic powder flake 12 of FIG. 4 and the magnetic powder flake 12' of FIG. 5 may be used. In addition, magnetic powder flakes having a shape capable of allowing the magnetic flux generated by the coil and the long axis to be in parallel with each other, in addition to the shapes illustrated in FIGS. 4A through 5B, may be used without limitations.

Referring to FIGS. 5A and 5B, a cross section of the magnetic powder flake 12' may be oval. In a case in which the cross section of the magnetic powder flake is oval, when the center O of a flake corresponds to an intersection point of a T axis, an L axis, and a W axis, which are central axes of a three-dimensional structure, a maximum length $L_W$ of the magnetic powder flake extended in a W axis direction may be the shortest of the sides of the flake, extended in the three axis directions, and a maximum length $L_L$ of the magnetic powder flake extended in an L axis direction may be shorter than a maximum length $L_T$ of the magnetic powder flake extended in a T axis direction, but may be longer than the maximum length $L_W$ of the magnetic powder flake extended in the W axis direction. The maximum length $L_T$ of the magnetic powder flake extended in the T axis direction may be the longest of the three lengths.

Therefore, it may be appreciated that the magnetic powder flake 12' having a plate shape, illustrated in FIGS. 5A and 5B, may have a single long axis, and may be formed to be in parallel with the T axis.

Therefore, regardless of a cross-sectional shape of the magnetic powder flakes, when the magnetic powder flake contained in the core according to the present disclosure is formed so that the maximum length $L_W$ thereof extended in the W axis direction is always shorter than the maximum length thereof extended in the L or T axis direction, the magnetic powder flakes may be arranged so as to concentrate the magnetic flux of the coil. In a case in which the magnetic powder flake is disposed so that the long axis of the magnetic powder flake is not in parallel with the W axis, but is in parallel with the T axis and/or the L axis, when a flow of the magnetic flux is formed alternately in the T axis direction and the L axis direction, the magnetic flux may be concentrated to be around the T axis or the L axis.

In a case of the magnetic powder flake 12' of FIGS. 5A and 5B, since the magnetic flux is concentrated in one direction, the magnetic powder flake 12' may be useful in an embodiment in which a central portion of the core and an outside portion of the core are formed of separate bodies.

Figure 6:
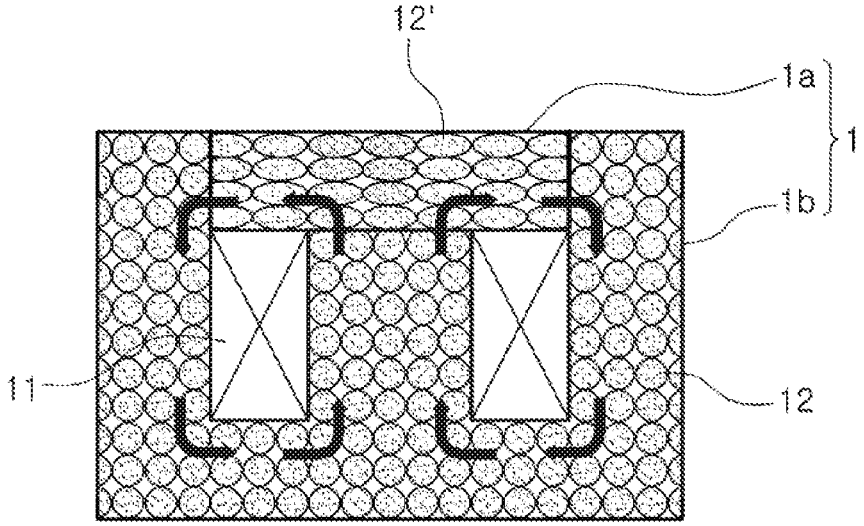
FIG. 6 is a cross-sectional view of a modified example of the wire-wound type power inductor of FIG. 1.

Embodiments of the present disclosure will be described with reference to FIG. 6. In a case in which the first body contains magnetic powder flakes having a plurality of long axes, the first body may be formed in an E-type structure to configure both the central portion of the core and the outside portion of the core, including a magnetic flux perpendicular to a magnetic flux of the central portion of the core. On the contrary, in a case in which the second body contains magnetic powder flakes having a single long axis, the second body may be formed in an I-type structure to configure only a portion of the outside portion of the core. In this case, a coupling structure of the first and second bodies may have a structure in which the I-type structure and the E-type structure are combined, and the direction of the magnetic flux and the long axis of the magnetic powder flakes in the core may be parallel with each other in an entire region of the core.

Next, modified examples of the wire-wound type power inductor, of which structures of first and second bodies are changed, will be described with reference to FIGS. 7A through 11. For convenience of explanation, a description of a winding coil that has already been described in relation to previous figures will be omitted, or only briefly described in relation to FIGS. 7A through 11.

Referring to FIGS. 7 through 11, it may be appreciated that in the wire-wound type inductor according to embodiments of the present disclosure, long axes of magnetic powder flakes and a direction of a magnetic flux are arranged to be in parallel with each other in an entire region of a core, such that the magnetic flux may be concentrated, and at the same time, such that it is easy to change a structure of the core in various shapes through a coupling structure between first and second bodies.

Figure 7A:
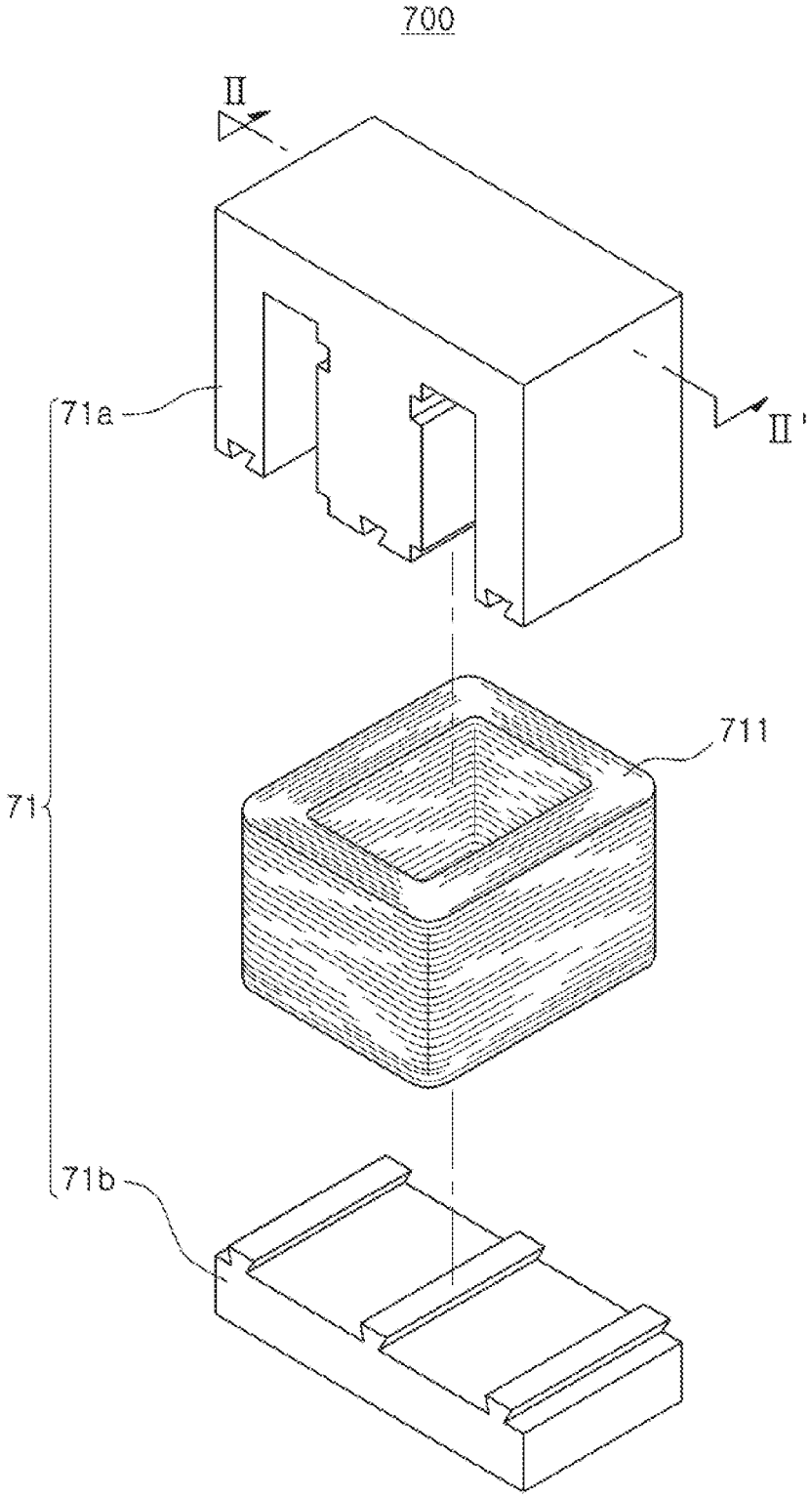
FIG. 7A is an exploded perspective view illustrating another modified example of the wire-wound type power inductor of FIG. 1.

Referring to FIG. 7A, a first body 71*a* of FIG. 7A may have an E-type structure similar to the first body 1*a* of FIG. 2. On the other hand, a second body 71*b* of FIG. 7A may have an I-type structure. In this case, in order to strengthen coupling strength between the first and second bodies, a concave portion is formed on a coupling surface of the first body, and a convex portion having a shape corresponding to the concave portion may be formed on a coupling surface of the second body coupled thereto, such that the first and second bodies may be coupled to each other by a fit-in method. Here, the concave portion and the convex portion may have a trapezoidal shape, but the shape thereof may also be changed to other shapes.

Figure 7B:
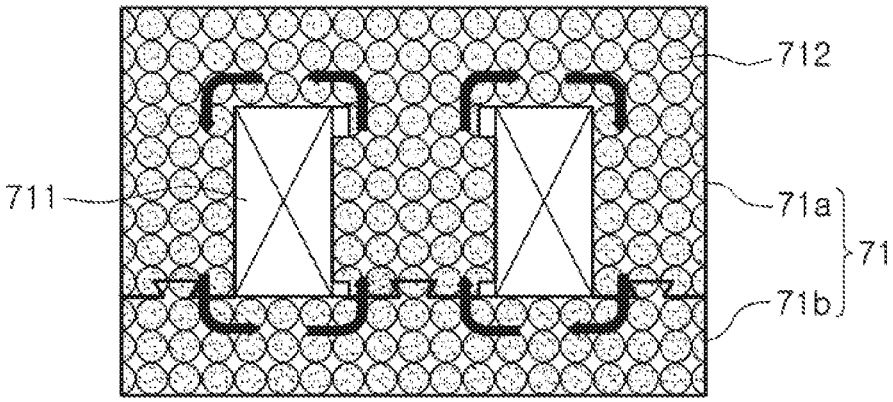
FIG. 7B is a cross-sectional view taken along line II-II' of FIG. 7A.

FIG. 7B is a cross-sectional view taken along line II-II' of FIG. 7A. Arrangement of magnetic powder flakes in a core may be appreciated from reference to FIG. 7B. Magnetic powder flakes 712 of FIG. 7B may also be disposed so that a long axis thereof is in parallel with a direction of a magnetic flux in an entire region of the core.

Figure 8A:
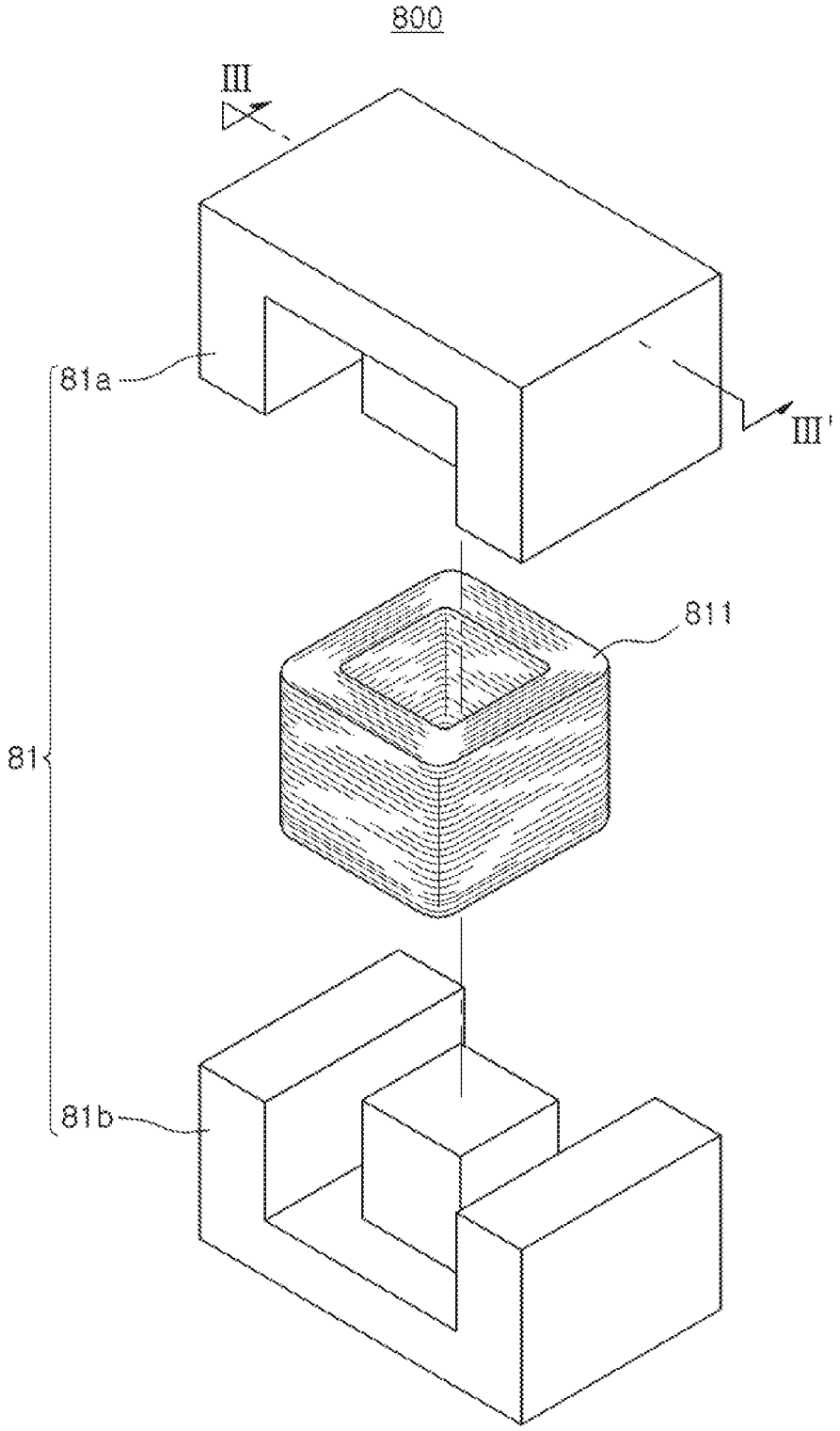
FIG. 8A is an exploded perspective view illustrating another modified example of the wire-wound type power inductor of FIG. 1.

Referring to FIG. 8A, a first body 81*a* of FIG. 8A may have an E-type structure similar to the first body 1*a* of FIG. 2, but a central portion of the first body 81*a* may have a hexahedral shape, rather than a cylinder shape. In this case, a winding coil wound around the central portion may preferably have a quadrangular shape. Similarly, a second body 81*b* of FIG. 8A may have an E-type structure in which a central portion thereof has a hexahedral shape.

Figure 8B:
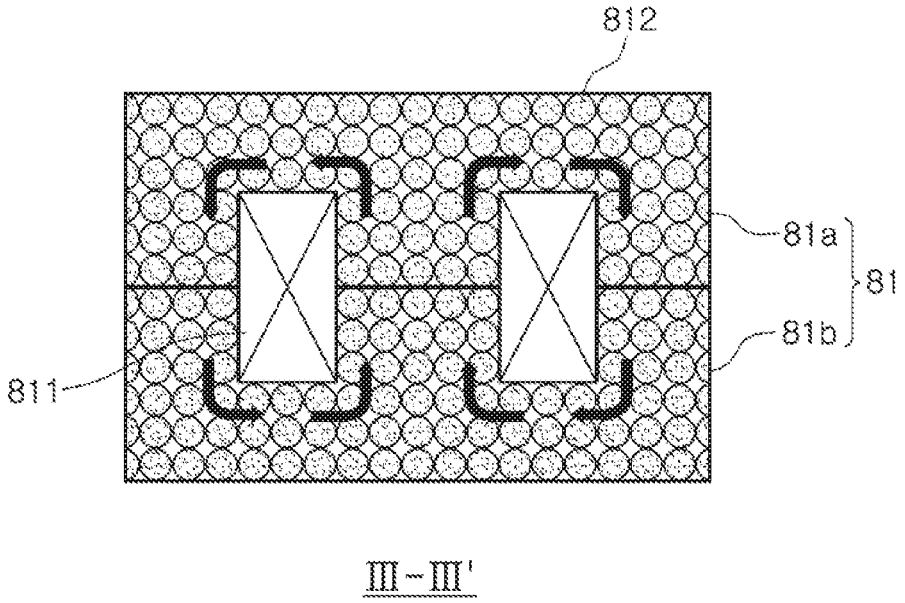
FIG. 8B is a cross-sectional view taken along line III-III' of FIG. 8A.

FIG. 8B is a cross-sectional view taken along line III-III' of FIG. 8A. The arrangement of magnetic powder flakes in a core may be appreciated from reference to FIG. 8B. The magnetic powder flakes 812 of FIG. 8B may also be disposed so that long axes thereof are in parallel with a direction of a magnetic flux in an entire region of the core.

Figure 9A:
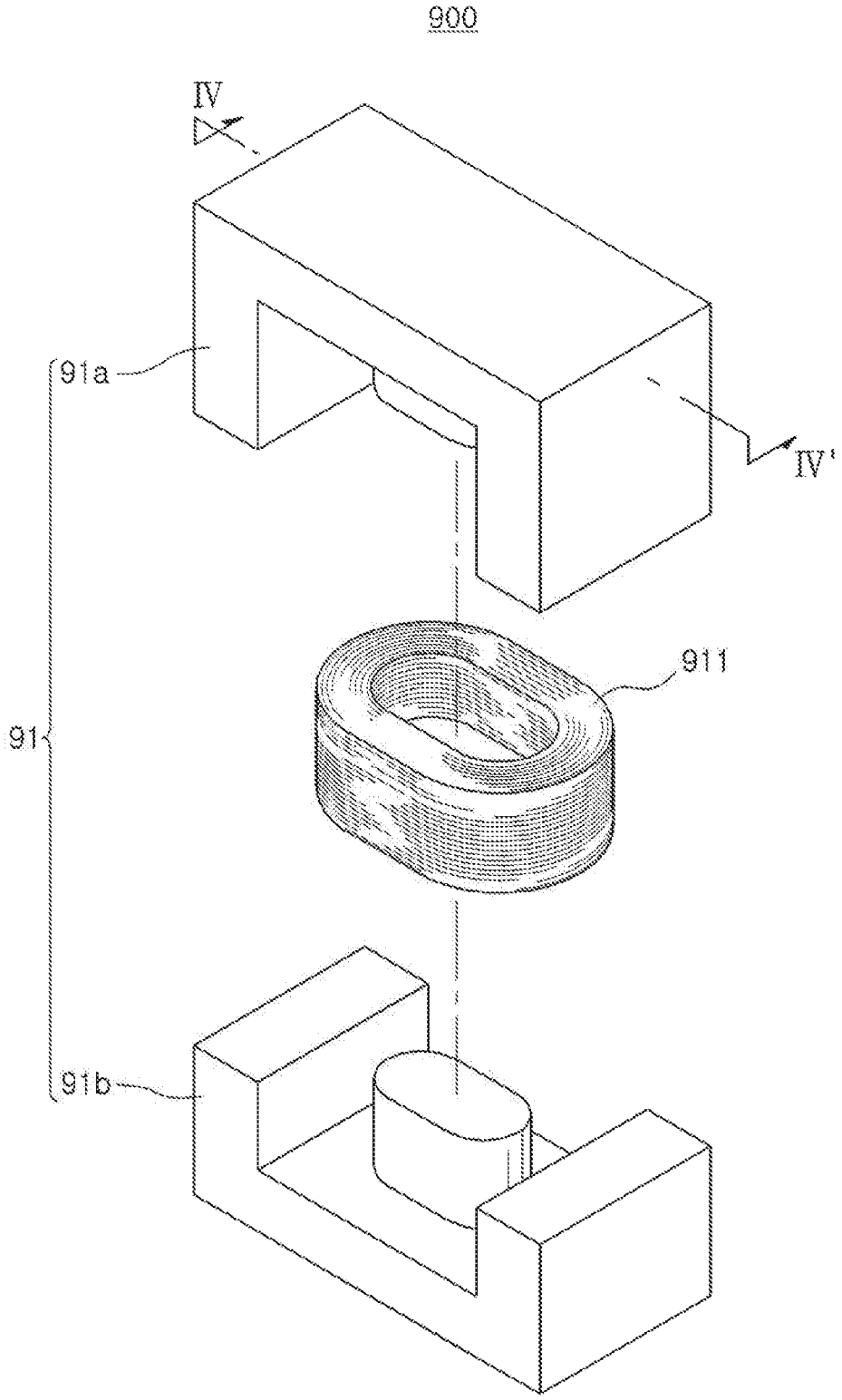
FIG. 9A is an exploded perspective view illustrating another modified example of the wire-wound type power inductor of FIG. 1.
Figure 9B:
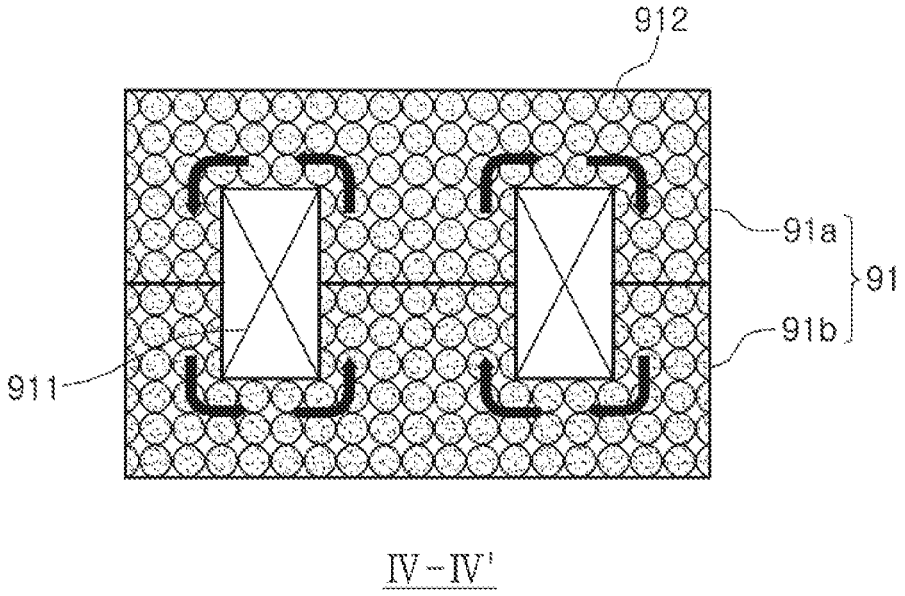
FIG. 9B is a cross-sectional view taken along line IV-IV' of FIG. 9A.

Referring to FIG. 9A, a first body 91*a* of FIG. 9A may have an E-type structure similar to the first body 1*a* of FIG. 2, but a central portion of the first body 91*a* may have a cylindroid shape having an oval cross section, rather than a cylinder shape. In this case, a shape of a winding coil wound around the central portion may also be changed to an oval shape and, similarly, a second body 91*b* of FIG. 9A may also have an E-type structure in which a central portion thereof has a cylindroid shape.

Figure 10A:
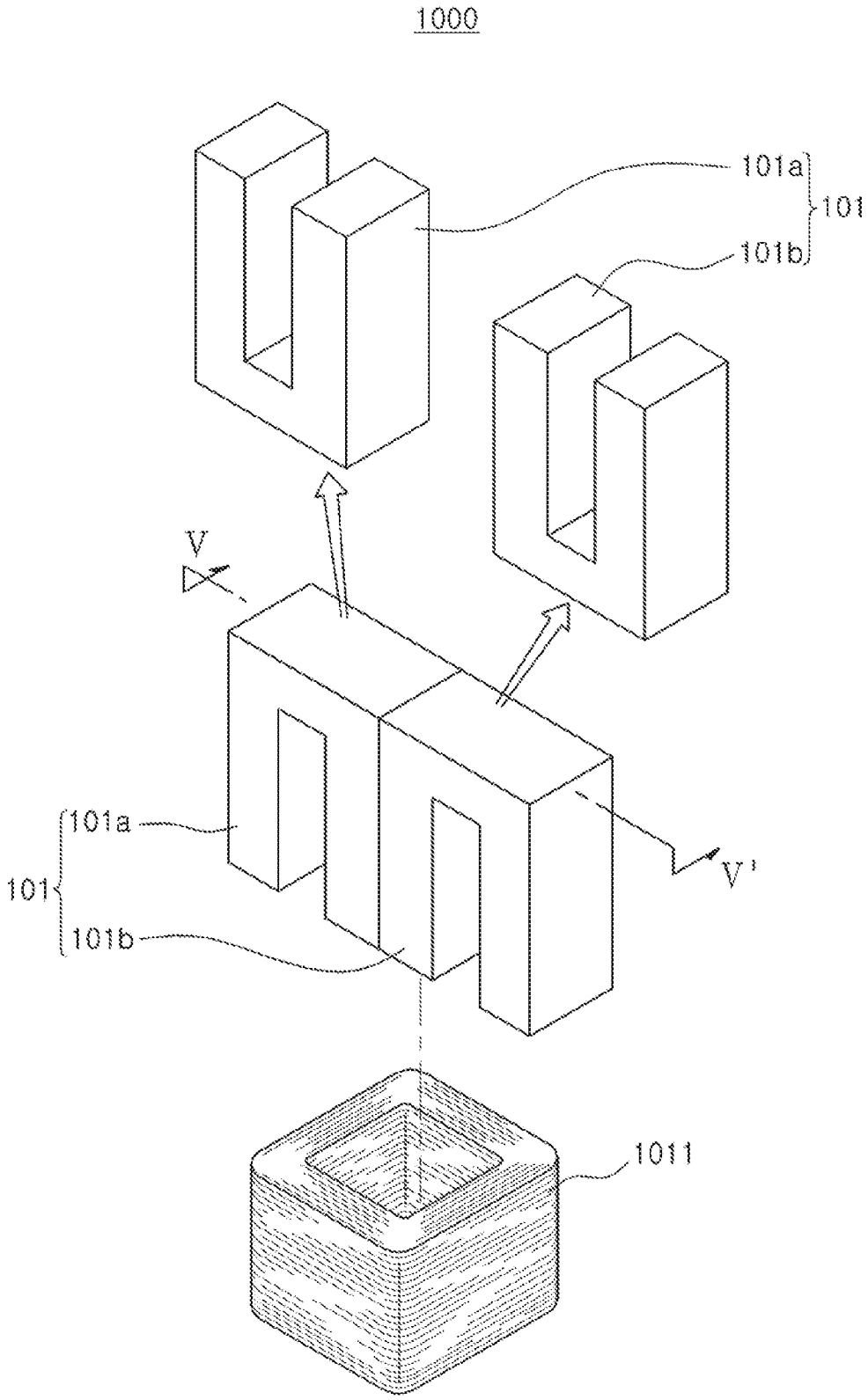
FIG. 10A is an exploded perspective view illustrating another modified example of the wire-wound type power inductor of FIG. 1.
Figure 10B:
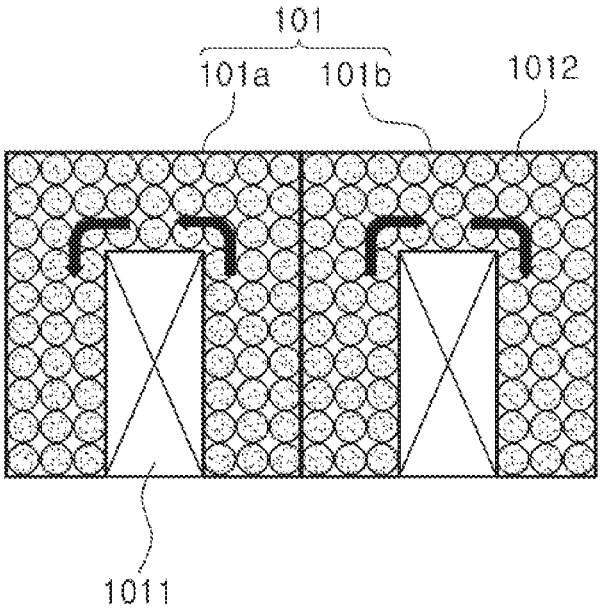
FIG. 10B is a cross-sectional view taken along line V-V' of FIG. 10A.

Referring to FIG. 10A, a first body 101*a* of FIG. 10A may have a U-type shape, and a second body 101*b* may also have the U-type shape similar to the first body. The first and second bodies 101*a* and 101*b* may have various coupling structures, depending on a coupling method, but in the present specification, only one example of the coupling structure will be described. In detail, one side surface of the U-type structure of the first body and one side surface of the U-type structure of the second body may be disposed to contact each other, and a winding coil may be wound so as to pass through both a cavity of the first body and a cavity of the second body. In this case, although not illustrated, both first and second lead portions of the winding coil may be led to a lower surface of a core. Here, in a case of connecting the first lead portion to a first external electrode, connecting the second lead portion to a second external electrode, and allowing the first and second external electrodes not to be extended to side surfaces of the core, lower electrodes may be configured. Meanwhile, the first and second external electrodes may also be extended to the side surfaces of the core, such that external electrodes having an L-type shape may also be formed. Further, although not illustrated, the first or second body having the U-type structure may also be independently utilized. In this case, similarly, the body and the coil may be coupled to each other so that long axes of magnetic powder flakes in the body are in parallel with a direction of a magnetic flux generated by the coil.

Figure 11A:
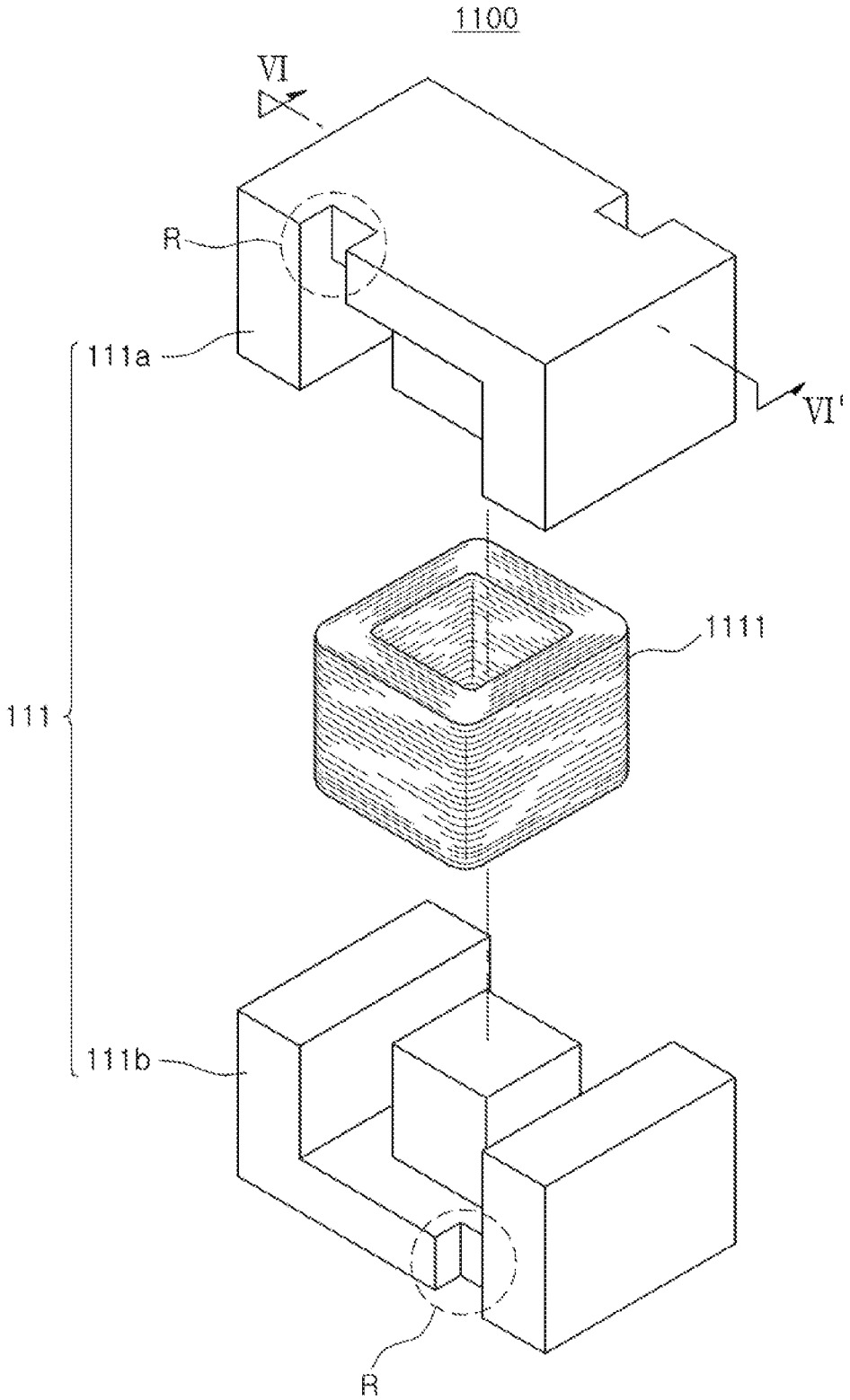
FIG. 11A is an exploded perspective view illustrating another modified example of the wire-wound type power inductor of FIG. 1.
Figure 11B:
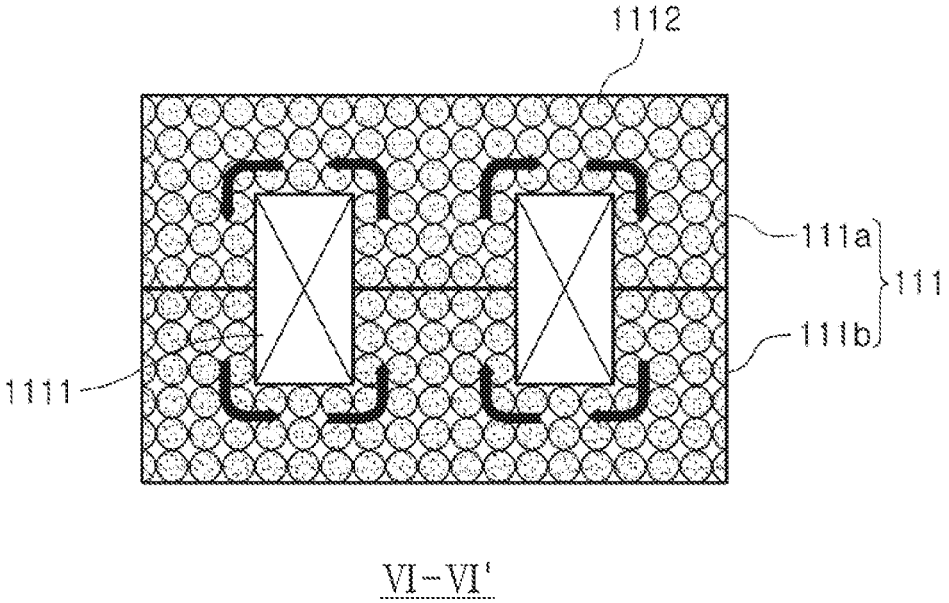
FIG. 11B is a cross-sectional view taken along line VI-VI' of FIG. 11A.

FIG. 11*a* illustrates a case in which each of the first and second bodies of FIG. 8A includes a groove portion R to which first and second lead portions of a coil may be exposed. The groove portion may be selectively disposed by those skilled in the art at a desired position to which the coil is exposed, and the number of groove portions is not limited to the number shown.

The wire-wound type inductor described above may have high permeability by disposing the magnetic powder flakes having shape magnetic anisotropy in the core, having the coupling structure of the first and second bodies so that the long axes thereof are in parallel with the direction of the magnetic flux generated by the coil in the core. Further, since the wire-wound type inductor according to exemplary embodiments of the present disclosure includes the first and second bodies in which arrangements of the long axes of the magnetic powder flakes in a specific direction are relatively complete before the coil is disposed in the core, a process of allowing the long axes of the magnetic powder flakes to be in parallel with the direction of the magnetic flux of the coil may be stably performed.

As set forth above, according to exemplary embodiments of the present disclosure, the flakes having shape magnetic anisotropy may be applied as the magnetic powder, and the long axes of the flakes may be disposed to be in parallel with the direction of the magnetic field of the coil in both the central portion and the outside portion of the core, such that the wire-wound type power inductor, of which permeability is significantly improved and structural reliability is secured, may be provided.

While exemplary embodiments have been shown and described above, it will be apparent to those skilled in the art that modifications and variations could be made without departing from the scope of the present invention as defined by the appended claims.

What is claimed is:

1. A wire-wound type inductor, comprising:

a core containing magnetic powder flakes and including a central portion, outside portions, and connection portions extending in a length direction of the core between the central portion and a respective outside portion of the outside portions; and a winding coil disposed in the core and wound around the central portion of the core, wherein the core has a coupling structure including first and second bodies coupled to each other in a thickness direction of the core, the first and second bodies contain magnetic powder flakes having shape magnetic anisotropy, and long axes of the magnetic powder flakes in the central portion are arranged in parallel with a direction in which a magnetic field of the winding coil is generated in the central portion and arranged in parallel with long axes of the magnetic powder flakes in at least one of the connection portions, and planes of the magnetic powder flakes are arranged orthogonally to a width direction of the core.

2. The wire-wound type inductor of claim 1, wherein an adhesive material is disposed on a coupling surface of the first body coupled to the second body among outer surfaces of the first body, and on a coupling surface of the second body coupled to the first body among outer surfaces of the second body.

3. The wire-wound type inductor of claim 1, wherein each of the magnetic powder flakes contained in the first body and each of the magnetic powder flakes contained in the second body includes a plurality of long axes, and at least one of the long axes is perpendicular to another long axis.

4. The wire-wound type inductor of claim 1, wherein each of the magnetic powder flakes contained in the first body includes a plurality of long axes and each of the magnetic powder flakes contained in the second body includes a single long axis, the second body has an I-type structure, and the long axis of the magnetic powder flake in the second body is perpendicular to one of the long axes of the magnetic powder flakes in the first body.

5. The wire-wound type inductor of claim 1, wherein each of the magnetic powder flakes contained in the first body and each of the magnetic powder flakes contained in the second body has a single short axis separate from a long axis, and the short axis is perpendicular to the direction of the magnetic field of the winding coil in the central portion and the outside portions of the core.

6. The wire-wound type inductor of claim 1, wherein the magnetic powder flake has a plate shape or ribbon shape.

7. The wire-wound type inductor of claim 1, wherein the first body has an E-type structure.

8. The wire-wound type inductor of claim 7, wherein a central portion of the first body has a hexahedral structure.

9. The wire-wound type inductor of claim 7, wherein a central portion of the first body has a cylindroid structure having an oval cross section.

10. The wire-wound type inductor of claim 7, wherein the second body has an E-type structure.

11. The wire-wound type inductor of claim 1, wherein the winding coil includes a solenoid-type coil body and first and second lead portions connected to both end portions of the coil body, and the first body includes at least one groove portion, to which the first lead portion is led, and the second body includes at least one groove portion, to which the second lead portion is led.

12. The wire-wound type inductor of claim 1, wherein the winding coil includes a solenoid-type coil body and first and second lead portions connected to both end portions of the coil body, the first and second lead portions being led only to a lower surface of the core.

13. The wire-wound type inductor of claim 1, wherein the magnetic powder flake contained in the core of the wire-wound type inductor has a core-shell structure, a core of the magnetic powder flake contains a metal, and a shell thereof contains an epoxy resin, and a surface of the core of the magnetic powder flake is covered by the shell of the magnetic powder flake, and the shell is disposed directly on the surface of the core of the magnetic powder flake.

14. The wire-wound type inductor of claim 1, wherein the first body has a U-type structure.

15. The wire-wound type inductor of claim 14, wherein the second body has a U-type structure, the first body has a coupling surface contacting the second body among outer surfaces thereof, and the second body has a coupling surface contacting the first body among outer surfaces thereof, and the winding coil is wound based on the coupling surface of the first body or the coupling surface of the second body.

16. A wire-wound type inductor, comprising:

a core containing magnetic powder flakes and including a central portion, outside portions, and connection portions extending in a length direction of the core between the central portion and a respective outside portion of the outside portions; and a winding coil disposed in the core and wound around the central portion of the core, wherein the core has a coupling structure including first and second bodies coupled to each other in a thickness direction of the core, the first and second bodies contain magnetic powder flakes having two long axes perpendicular to each other, and at least one of the two long axes of the magnetic powder flakes in the central portion is arranged in parallel with a direction in which a magnetic field of the winding coil is generated in the central portion and arranged in parallel with long axes of the magnetic powder flakes in at least one of the connection portions, and planes of the magnetic powder flakes are arranged orthogonally to a width direction of the core.

17. The wire-wound type inductor of claim 16, wherein an adhesive material is disposed on a coupling surface of the first body coupled to the second body among outer surfaces of the first body, and on a coupling surface of the second body coupled to the first body among outer surfaces of the second body.

18. The wire-wound type inductor of claim 16, wherein the magnetic powder flake has a plate shape or ribbon shape.

19. The wire-wound type inductor of claim 16, wherein the first body has an E-type structure.

* * * * *